US008517617B2

(12) United States Patent
Hashimoto

(10) Patent No.: US 8,517,617 B2
(45) Date of Patent: Aug. 27, 2013

(54) PRINTER AND METHOD FOR CONTROLLING THE SAME

(75) Inventor: Naoki Hashimoto, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 384 days.

(21) Appl. No.: 12/882,334

(22) Filed: Sep. 15, 2010

(65) Prior Publication Data

US 2011/0097129 A1 Apr. 28, 2011

(30) Foreign Application Priority Data

Oct. 28, 2009 (JP) ..... 2009-248137

(51) Int. Cl.
*B41J 11/42* (2006.01)
*G03G 15/00* (2006.01)

(52) U.S. Cl.
USPC ..... 400/582; 400/76; 399/392; 399/401

(58) Field of Classification Search
USPC ..... 400/76, 582; 399/392, 401
See application file for complete search history.

(56) References Cited

U.S. PATENT DOCUMENTS

| | | | | |
|---|---|---|---|---|
| 6,496,281 | B1 | 12/2002 | Yamamoto et al. | |
| 2006/0127149 | A1* | 6/2006 | Togashi et al. | 399/392 |
| 2009/0087237 | A1 | 4/2009 | Sato | |
| 2012/0134731 | A1* | 5/2012 | Fukusada et al. | 400/582 |

FOREIGN PATENT DOCUMENTS

| | | | |
|---|---|---|---|
| JP | 6089052 | A | 3/1994 |
| JP | 11268840 | A | 10/1999 |
| JP | 2002116591 | A | 4/2002 |
| JP | 2005-219860 | | 8/2005 |
| JP | 2006188324 | A | 7/2006 |
| JP | 2007-076782 | | 3/2007 |
| JP | 2009-086506 | | 4/2009 |

OTHER PUBLICATIONS

Notification of Reasons for Rejection for Japanese patent application No. 2009-248137 mailed Oct. 4, 2011.

* cited by examiner

*Primary Examiner* — Leslie J Evanisko
(74) *Attorney, Agent, or Firm* — Banner & Witcoff, Ltd.

(57) ABSTRACT

A printer is provided that includes a double-side feeding path on which a first sheet is conveyed in a double-side printing operation, a manual feeding path on which a manually-fed second sheet is conveyed to a junction where the manual feeding path joins the double-side feeding path, a detector detecting the second sheet fed via the manual feeding path, and a controller configured to continue the double-side printing operation when the detector detects the second sheet during a continued-execution period, during which feeding of the second sheet is unlikely to have an influence on feeding of the first sheet even though the second sheet is fed via the manual feeding path in execution of the double-side printing operation. When the detector detects the second sheet outside the continued-execution period, the controller stops the double-side printing operation.

14 Claims, 7 Drawing Sheets

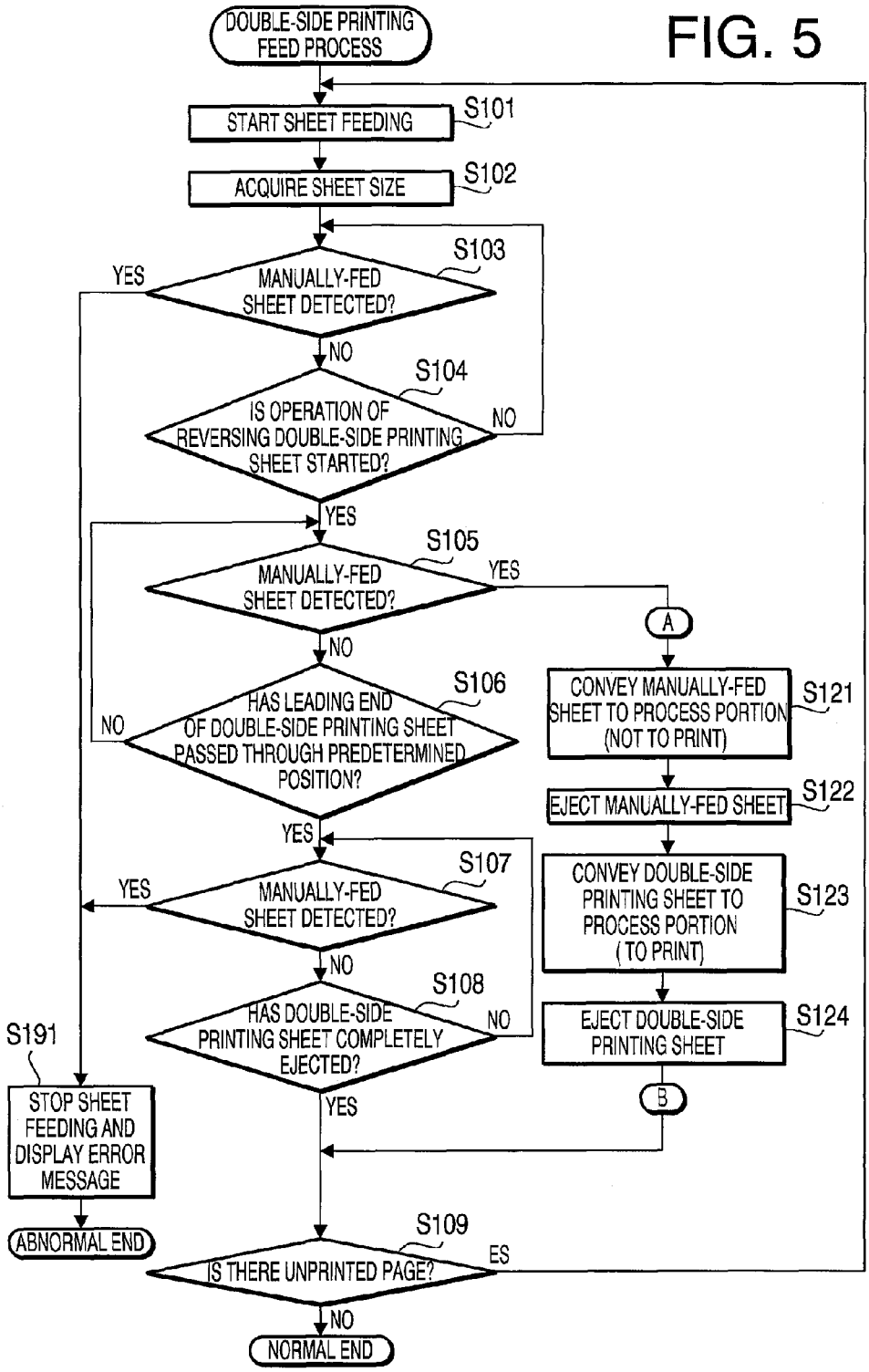
FIG. 5
DOUBLE-SIDE PRINTING FEED PROCESS
START SHEET FEEDING
S101
ACQUIRE SHEET SIZE
S102
MANUALLY-FED SHEET DETECTED?
S103
YES
NO
IS OPERATION OF REVERSING DOUBLE-SIDE PRINTING SHEET STARTED?
S104
NO
YES
MANUALLY-FED SHEET DETECTED?
S105
YES
NO
HAS LEADING END OF DOUBLE-SIDE PRINTING SHEET PASSED THROUGH PREDETERMINED POSITION?
S106
NO
YES
MANUALLY-FED SHEET DETECTED?
S107
YES
NO
HAS DOUBLE-SIDE PRINTING SHEET COMPLETELY EJECTED?
S108
NO
YES
A
CONVEY MANUALLY-FED SHEET TO PROCESS PORTION (NOT TO PRINT)
S121
EJECT MANUALLY-FED SHEET
S122
CONVEY DOUBLE-SIDE PRINTING SHEET TO PROCESS PORTION (TO PRINT)
S123
EJECT DOUBLE-SIDE PRINTING SHEET
S124
B
S191
STOP SHEET FEEDING AND DISPLAY ERROR MESSAGE
ABNORMAL END
IS THERE UNPRINTED PAGE?
S109
ES
NO
NORMAL END

PRINTER AND METHOD FOR CONTROLLING THE SAME

CROSS-REFERENCE TO RELATED APPLICATION

This application claims priority under 35 U.S.C. §119 from Japanese Patent Application No. 2009-248137 filed on Oct. 28, 2009. The entire subject matter of the application is incorporated herein by reference.

BACKGROUND

1. Technical Field

The following description relates to one or more technologies for a printer that has a double-side printing function, more specifically, to one or more technologies for a printer that includes a feeding path configured to guide a manually inserted sheet to a printing unit (hereinafter, referred to as a "manual sheet feeding path").

2. Related Art

A printer has been known that is configured to perform double-side printing by automatically reversing a sheet using a re-feeding path. In addition, a printer has been known that includes a manual sheet feeding path for guiding, to a printing unit, a sheet that is manually inserted by a user. Further, a printer has been known that includes both the double-side printing function and the manual sheet feeding path.

SUMMARY

However, the known printer, which includes both the double-side printing function and the manual sheet feeding path, has the following problem. For the known printer, a sufficient study has not been conducted on how to deal with a situation where a sheet is inserted onto the manual sheet feeding path during a double-side printing operation. For example, in the case where the double-side printing operation is always interrupted in an abnormal manner when a sheet is supplied via the manual sheet feeding path, it is possible to prevent a feeding error such as a sheet jam and overlap between sheets but impossible to maintain continuity of the printing operation.

Aspects of the present invention are advantageous to provide one or more improved techniques for a printer that make it possible to perform effective operations to meet a situation where a sheet is inserted via a manual sheet feeding path during a double-side printing operation.

According to aspects of the present invention, a printer is provided that includes a double-side feeding path configured such that a first sheet is conveyed thereon in a double-side printing operation, a manual feeding path configured such that a manually-fed second sheet is conveyed thereon to a junction where the manual feeding path joins the double-side feeding path, a detector configured to detect the second sheet manually fed via the manual feeding path, and a controller configured to, when the detector detects the second sheet during a continued-execution period, continue the double-side printing operation for the first sheet which is being conveyed on the double-side feeding path. The controller is further configured to, when the detector detects the second sheet outside the continued-execution period, stop the double-side printing operation. The continued-execution period is determined as a period during which feeding of the second sheet is unlikely to have an influence on feeding of the first sheet even though the second sheet is manually fed via the manual feeding path in execution of the double-side printing operation.

According to aspects of the present invention, further provided is a method, configured to be implemented on a processor, for controlling a printer. The printer includes a double-side feeding path configured such that a first sheet is conveyed thereon in a double-side printing operation, a manual feeding path configured such that a manually-fed second sheet is conveyed thereon to a junction where the manual feeding path joins the double-side feeding path, and a detector configured to detect the second sheet manually fed via the manual feeding path. The method includes a step of determining whether the detector detects the second sheet during a continued-execution period, wherein the continued-execution period is determined as a period during which feeding of the second sheet is unlikely to have an influence on feeding of the first sheet even though the second sheet is manually fed via the manual feeding path in execution of the double-side printing operation, a step of, when it is determined that the detector detects the second sheet during the continued-execution period, continuing the double-side printing operation for the first sheet which is being conveyed on the double-side feeding path, and a step of, when it is determined that the detector detects the second sheet outside the continued-execution period, stopping the double-side printing operation.

BRIEF DESCRIPTION OF THE ACCOMPANYING DRAWINGS

FIG. 1 is a perspective view schematically showing an external configuration of a printer according to one or more aspects of the present invention.

FIG. 2 schematically shows an internal configuration of an image forming unit of the printer according to one or more aspects of the present invention.

FIG. 5 is a flowchart showing a procedure of a double-side printing feed process in a first embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, embodiments according to aspects of the present invention will be described with reference to the accompany drawings. In the embodiments, aspects of the present invention are applied to a color printer configured to perform double-side printing in an electrophotographic method.

[Overall Configuration of Printer]

Figure 1:
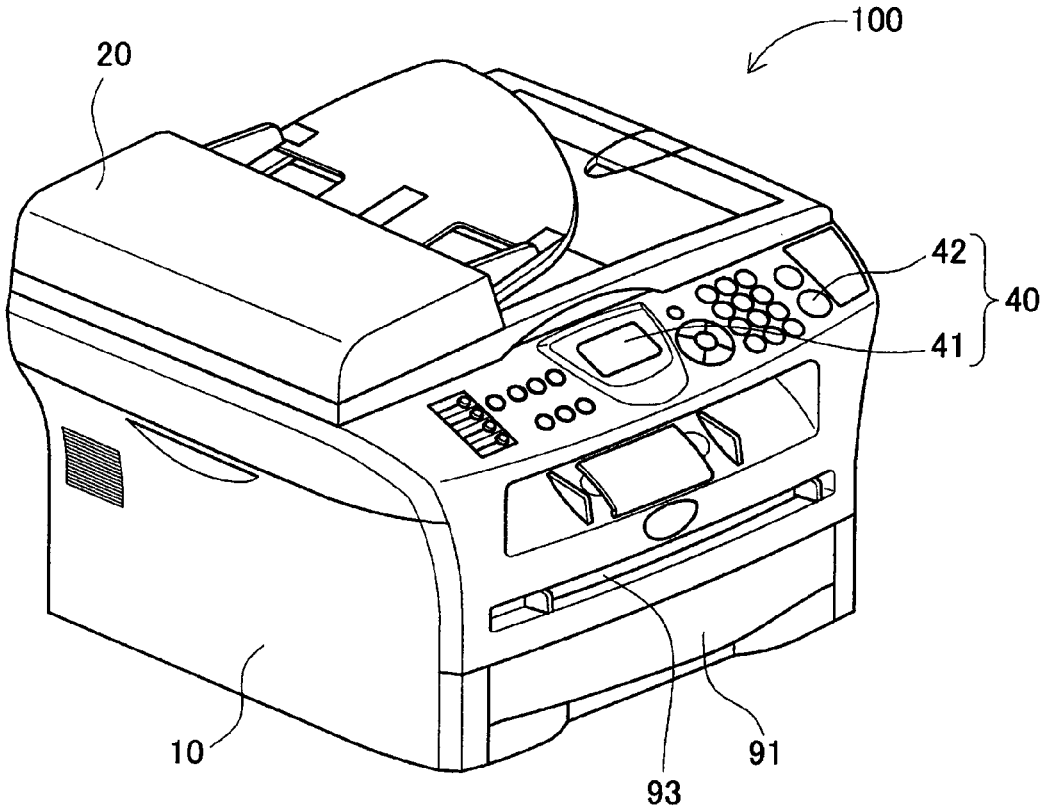

As illustrated in FIG. 1, a printer 100 according to aspects of the present invention includes an image forming unit 10 configured to form an image on a sheet, and an image reading unit 20 configured to read an image on a document sheet. Further, the printer 100 includes an operation panel 40 disposed in front of the image reading unit 20. The operation panel 40 is provided with a display unit 41 having a liquid crystal display (LCD) device, and a button group 42 having various buttons such as a start key, a stop key, and numeric keypad. The operation panel 40 makes it possible to display an operational status of the printer 100 and accept an input from a user.

Additionally, the printer 100 includes a feed cassette 91 disposed in a bottom region of the image forming unit 10. The feed cassette 91 is detachably attached to the main body of the printer 100, and configured to accommodate sheets. Further, the printer 100 includes a manual feeding inlet 93, which is provided at a side face of the image forming unit 10 and configured such that a user manually insert a sheet therethrough.

[Configuration of Image Forming Unit]

Figure 2:
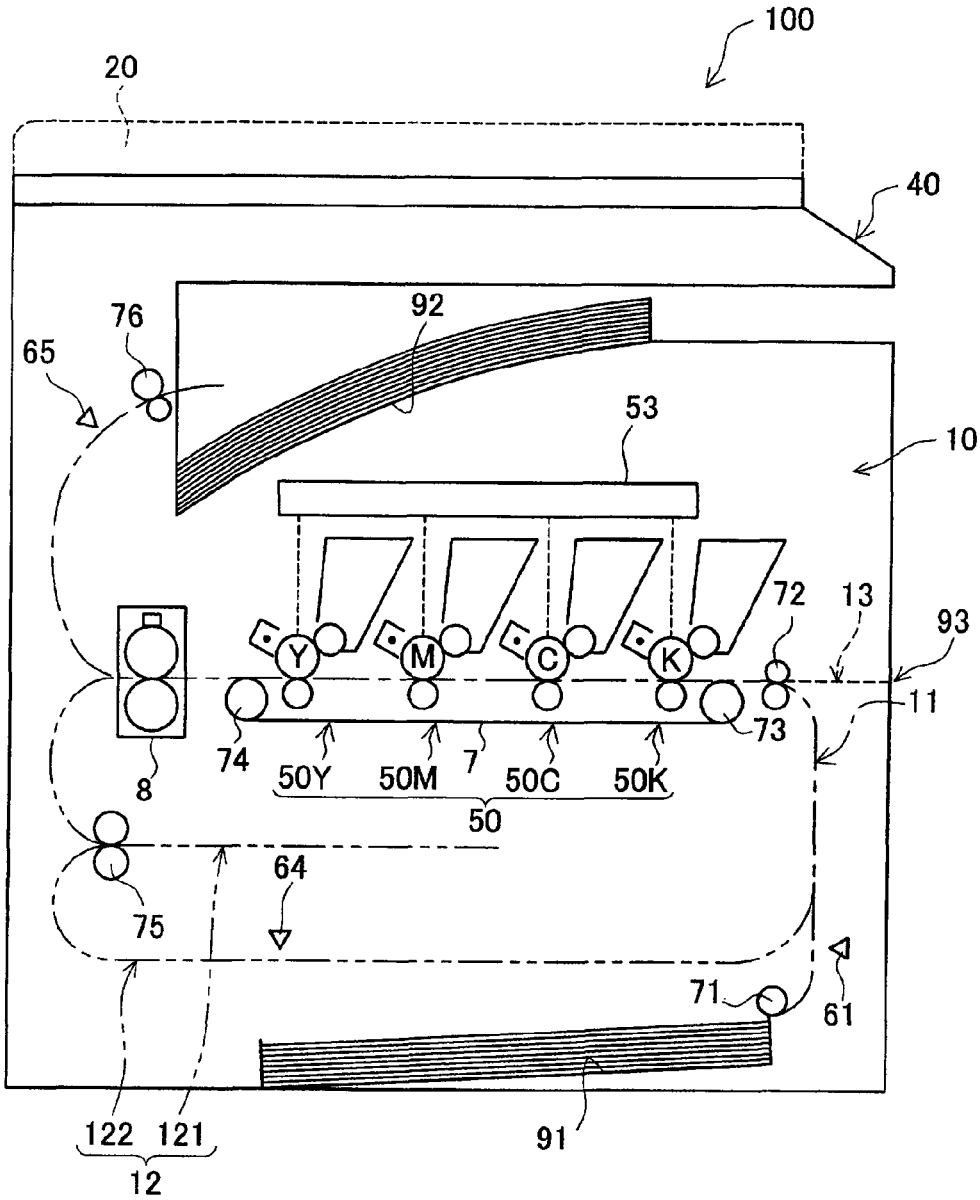

As depicted in FIG. 2, the image forming unit 10 includes a process portion 50 configured to form a toner image and transfer the toner image onto a sheet, a fixing unit 8 configured to fix unfixed toner on the sheet, the feed cassette 91 configured such that unprinted sheets are placed therein, and a catch tray 92 configured to receive printed sheets thereon. Further, the image forming unit 10 includes therein a substantially S-shaped feeding path 11 (indicated by an alternate long and short dash line in FIG. 2) formed to guide sheets placed in the feed cassette 91 upward to the catch tray 92 via a feed roller 71, registration rollers 72, the process portion 50, the fixing unit 8, and ejection rollers 76.

The process portion 50 is configured to form a color image, and provided with process units disposed in parallel to each other, which corresponds to the colors, yellow (Y), magenta (M), cyan (C), and black (K), respectively. Specifically, the process portion 50 includes a process unit 50Y configured to form a yellow (Y) image, a process unit 50M configured to form a magenta (M) image, a process unit 50C configured to form a cyan (C) image, and a process unit 50K configured to form a black (K) image. Further, the process portion 50 includes an exposure unit 53 configured to illuminate the process units 50Y, 50M, 50C, and 50K with light, and a conveying belt 7, hung around a pair of rollers 73 and 74, which is configured to convey a sheet thereon to each transfer position of the process units 50Y, 50M, 50C, and 50K. Each of the process units 50Y, 50M, 50C, and 50K forms a toner image in a known electrophotographic method.

The image forming unit 10 is configured to pick up a sheet (sheets) placed in the feed cassette 91 on a sheet-by-sheet basis, feed the sheet to the process portion 50, and transfer onto the sheet the toner images formed by the process portion 50. Further, the image forming unit 10 is configured to convey to the fixing unit 8 the sheet with the toner images transferred thereon, fix the toner images onto the sheet, and then eject onto the catch tray 92 the sheet with the toner images fixed thereon.

In addition, the image forming unit 10 includes therein a double-side printing mechanism for performing printing on both sides of a sheet. A feeding path 12 (indicated by an alternate long and two short dashes line in FIG. 2) is a feeding path for re-feeding a sheet, of which a first side has been printed, to the process portion 50 with a traveling direction of the sheet being reversed such that a second side, opposite to the first side, of the sheet is printed. The feeding path 12 diverges from the feeding path 11 in a position downstream relative to the fixing unit 8 in a sheet feeding direction. Further, the feeding path 12 includes a feeding path 121 (hereinafter referred to as a "temporary-stop path 121") on which the sheet temporarily stays to reverse the traveling direction of the sheet, and a feeding path 122 (hereinafter referred to as a "return path 122") for returning onto the feeding path 11 the sheet with the traveling direction thereof reversed.

Specifically, in the double-side printing using the double-side printing mechanism, the traveling direction of a sheet is reversed in accordance with the following procedure. First, a first side of the sheet is printed via the feeding path 11 (hereinafter referred to as the "forward feeding path 11"). Then, the sheet with the first side thereof printed is conveyed onto the feeding path 12 (hereinafter referred to as the "re-feeding path 12") after the printed first side thereof is thermally fixed by the fixing unit 8. The sheet is fed onto the temporary-stop path 121, and then the sheet feeding is once stopped. After that, the traveling direction of the sheet is reversed by changing a rotational direction of turnaround rollers 75, and the sheet is conveyed onto the return path 122. Thereafter, the sheet is returned onto the forward feeding path 11 at an upstream side relative to the process portion 50 in the sheet feeding direction. Thereby, the sheet is reversed with the second side thereof facing up, and the second side is printed. Namely, in the image forming unit 10, a double-side feeding path is configured with the forward feeding path 11 and the re-feeding path 12.

Further, the image forming unit 10 includes therein a manual feeding mechanism for a user to manually insert a sheet. A feeding path 13 (which is indicated by a dashed line in FIG. 2, and hereinafter will be referred to as a "manual feeding path 13") is a path for guiding a sheet, which is inserted via the manual feeding inlet 93 provided at the side face of the image forming unit 10, to a junction 14 (see FIG. 3) where the manual feeding path 13 joins the forward feeding path 11. The manual feeding path 13 is configured with the manual feeding inlet 93 as an upstream end and the junction 14 as a downstream end in the sheet feeding direction. The junction 14 is located at an upstream side relative to the registration rollers 72 in the sheet feeding direction on the forward feeding path 11.

Specifically, in printing with the manual feeding mechanism, a sheet is fed in accordance with the following procedure. First, a sheet is inserted via the manual feeding inlet 93. The inserted sheet is fed onto the forward feeding path 11 via the manual feeding path 13. When inserted up to the registration rollers 72, the sheets is held between the registration rollers 72 to be conveyed into the image forming unit 10. After that, the sheet is printed while passing through the process portion 50. It is noted that the user is required to keep inserting the sheet until the sheet is held between the registration rollers 72. After held between the registration rollers 72, the sheet is automatically fed.

Further, the image forming unit 10 includes various sensors disposed therein to detect passage of a sheet. Specifically, as depicted in FIG. 2, a feed sensor 61 is disposed in a position just downstream relative to the feed roller 71 in the sheet feeding direction on the forward feeding path 11. The feed sensor 61 is utilized to acquire the length of a sheet passing therethrough, as well as to detect the sheet fed from the feed cassette 91.

Figure 3:
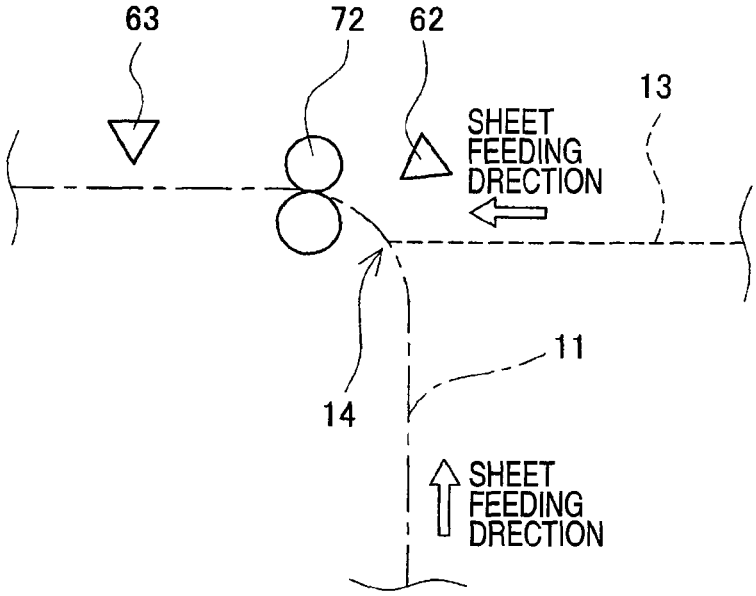
FIG. 3 is an illustration schematically showing a configuration of a region around registration rollers inside the image forming unit according to one or more aspects of the present invention.

Further, as illustrated in FIG. 3, a before-registration sensor 62 is disposed in a position just upstream relative to the registration rollers 72 in the sheet feeding direction on the forward feeding path 11. The before-registration sensor 62 is located at a downstream side in the sheet feeding direction relative to the junction 14 between the forward feeding path 11 and the manual feeding path 13, so as to double as a sensor detecting a sheet inserted via the manual feeding path 13. In addition, an after-registration sensor 63 is disposed in a position just downstream relative to the registration rollers 72 in the sheet feeding direction on the forward feeding path 11.

Further, as shown in FIG. 2, a re-feeding sensor 64 is disposed in a position downstream relative to the turnaround rollers 75 and upstream relative to a junction where the re-feeding path 12 joins the forward feeding path 11, in the sheet feeding direction on the re-feeding path 12. Moreover, an ejection sensor 65 is disposed in a position just upstream relative to the ejection rollers 76 in the sheet feeding direction on the forward feeding path 11. It is noted that the image forming unit 10 may include therein one or more other sensors.

[Electrical Configuration of Printer]

Figure 4:
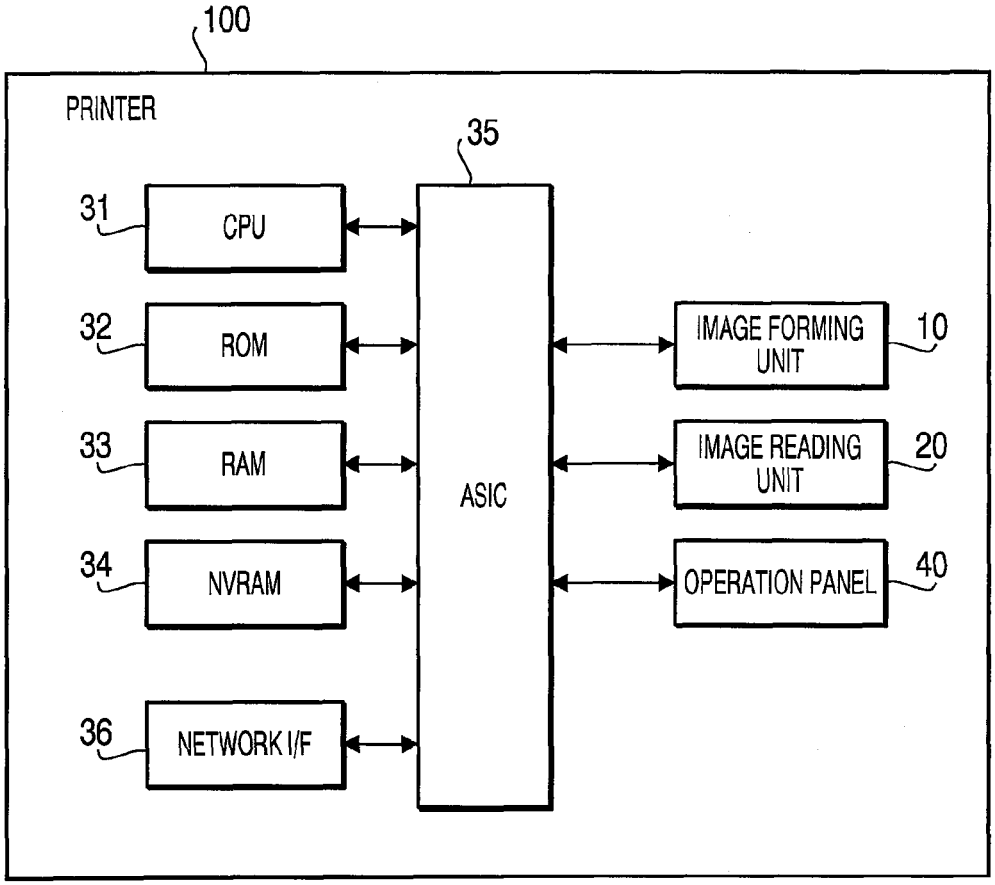
FIG. 4 is a block diagram schematically showing an electrical configuration of the printer according to one or more aspects of the present invention.

Subsequently, an explanation will be provided about an electrical configuration of the printer 100. As shown in FIG. 4, the printer 100 includes a CPU 31, a ROM 32, a RAM 33, a non-volatile RAM (NVRAM) 34, an ASIC 35, and a network interface 36. Further, the ASIC 35 is electrically connected with the image forming unit 10, the image reading unit 20, and the operation panel 40.

The ROM 32 stores various kinds of data to control the printer 100, such as various control programs, various settings, and initial values. The RAM 33 is utilized as a work area into which various control programs are read out or a storage area to temporarily store image data.

While storing, into the RAM 33 or the NVRAM 34, results of processing in accordance with the control programs read out of the ROM 32 and signals received from the various sensors, the CPU 31 controls each element of the printer 100 via the ASIC 35 (e.g., the CPU 31 controls the exposure unit 53 to be turned on or off at appropriate timing, controls drive motors (not shown) of rollers on the forward feeding path 11 and the re-feeding path 12, and controls a motor (not shown) to move an image sensor unit of the image reading unit 20).

The network interface 36 is connectable with a network such as the Internet, so as to establish connection with external devices having a printer driver for the printer 100 installed therein. Thus, the printer 100 can perform data communication (e.g., communication for a print job) with the external devices via the network interface 36.

[Double-Side Printing Feeding Process]

First Embodiment

Next, an explanation will be provided about a double-side printing feed process to be executed by the printer 100 (the CPU 31) with reference to FIG. 5. The printer 100 performs the double-side printing feed process, e.g., in response to receipt of an externally-transmitted print job for double-side printing or acceptance of an instruction of double-side printing via the operation panel 40. It is noted that in the following description, an explanation will be directed mainly to operations in the case where a sheet is inserted via the manual feeding inlet 93 during a double-side printing operation. An explanation about a printing operation will be omitted.

First, the printer 100 (the CPU 31) starts feeding a sheet from the feed cassette 91 (S101). It is determined based on a signal from the feed sensor 61 that a sheet is fed onto the forward feeding path 11. It is noted that in the following description, the sheet which is fed for double-side printing from the feed cassette 91 in S101 will be referred to as a "double-side printing sheet", and a sheet to be inserted via the manual feeding path 13 will be referred to as a "manually-fed sheet."

Subsequently, based upon a signal from the feed sensor 61, the printer 100 acquires the sheet size of the double-side printing sheet fed onto the forward feeding path 11 (S102). For instance, the printer 100 determines a time period between an earlier time when a leading end of the double-side printing sheet passes through the feed sensor 61 and a later time when a trailing end of the sheet passes through the feed sensor 61, based on signals from the feed sensor 61. Then, the printer 100 calculates the length of the double-side printing sheet based on the determined time period and a sheet feeding speed.

Next, the printer 100 determines whether there is a sheet inserted via the manual feeding path 13 during a time period between an earlier time to start feeding the double-side printing sheet and a later time to start reversing the double-side printing sheet (S103). When the trailing end of the double-side printing sheet is fed onto the re-feeding path 12, it is determined that an operation of reversing the double-side printing sheet is begun. It is determined, e.g., based on an elapsed time period after the after-registration sensor 63 detects the trailing end of the double-side printing sheet that the double-side printing sheet is fed onto the re-feeding path 12. The double-side feeding sheet fed onto the re-feeding path 12 is in a state where the first side thereof has been printed through the process portion 50. Additionally, the printer 100 recognizes a manually-fed sheet inserted via the manual feeding path 13 in response to detection by the before-registration sensor 61 at un-predicted timing. Namely, detection timing at which the double-side printing sheet is detected can be estimated based on an elapsed time period after the detection by the feed sensor 61 or the detection by the re-feeding sensor 64. However, detection timing at which the manually-fed sheet inserted via the manual feeding path 13 is detected cannot be anticipated.

During a time period until the operation of reversing the double-side printing sheet is begun, the double-side printing sheet is regarded to be conveyed on the forward feeding path 11. Hence, when there is a manually-fed sheet detected (S103: Yes) during the time period until the operation of reversing the double-side printing sheet is begun (i.e., in the case of "S104: No"), the double-side printing sheet is highly likely to collide with the manually-fed sheet. Therefore, in such a case, the printer 100 stops feeding the double-side printing sheet, and displays an error massage on the display unit 41 of the operation panel 40 (S191). Thereafter, the printer 100 abnormally terminates the double-side printing feed process.

Meanwhile, after determining that there is no manually-fed sheet detected (S103: No) and the operation of reversing the double-side printing sheet is begun (S104: Yes), the printer 100 determines whether there is a manually-fed sheet inserted via the manual feeding path 13 (S105) during a time period until the leading end of the double-side printing sheet passes through a predetermined position on the re-feeding path 12 which position is determined for each sheet size. The predetermined position is such a limit position that a manually-fed sheet is permitted to be inserted during a time period until the leading end of the double-side printing sheet passes therethrough. Further, the predetermined position varies depending on a sheet size. Therefore, for the printer 100, a limit position is previously set for each sheet size, and the predetermined position is determined responsive to the sheet size acquired in S102. It is determined, e.g., based on an elapsed time period after the re-feeding sensor 64 detects the leading end of the double-side printing sheet whether the leading end of the double-side printing sheet reaches the predetermined position. In this case, the re-feeding sensor 64 is located upstream relative to the predetermined position in the sheet feeding direction.

During a time period between an earlier time when the operation of reversing the double-side printing sheet is begun and a later time when the double-side printing sheet reaches the predetermined position, the double-side printing sheet is being conveyed on the re-feeding path 12. Therefore, when there is a manually-fed sheet detected during the above time period, feeding of the manually-fed sheet is unlikely to have an influence on feeding of the double-side printing sheet.

When there is a manually-fed sheet detected (S105: Yes) during the time period between the time when the operation of reversing the double-side printing sheet is begun and the time when the double-side printing sheet reaches the predetermined position (i.e., in the case of "S106: No"), the printer 100 conveys the manually-fed sheet to the process portion 50 (S121). It is noted that the manually-fed sheet is not printed as the feeding of the manually-fed sheet is unusual feeding during the double-side printing operation. Consequently, the printer 100 ejects the manually-fed sheet with no image printed thereon (S122).

Further, the double-side printing operation is still in execution, and the printer 100 returns the double-side printing sheet onto the forward feeding path 11 to convey the double-side printing sheet to the process portion 50 (S123). Then, the printer 100 performs printing on the second side of the double-side printing sheet. After that, the printer 100 ejects the double-side printing sheet with the first and second sides thereof printed (S124).

Meanwhile, after determining that there is no manually-fed sheet (S105: No) and the double-side printing sheet reaches the predetermined position (S106: Yes), the printer 100 determines whether there is a manually-fed sheet inserted via the manual feeding path 13 (S107) during a time period until the double-side printing sheet is ejected after again passing through the process portion 50. It is determined, e.g., based on an elapsed time period after detection of the trailing end of the double-side printing sheet by the ejection sensor 65 that the double-side printing sheet has completely been ejected.

During a time period between an earlier time when the double-side printing sheet reaches the predetermined position and a later time when the double-side printing sheet is ejected, the double-side printing sheet is considered in a process of being conveyed on the forward feeding path 11. Therefore, when there is a manually-fed sheet detected (S107: Yes) during the time period between the time when the double-side printing sheet reaches the predetermined position and the time when the double-side printing sheet is ejected (i.e., in the case of "S108: No"), the double-side printing sheet is highly likely to collide with the manually-fed sheet. Hence, the printer 100 stops feeding of both the double-side printing sheet and the manually-fed sheet, and displays an error message on the display unit 41 of the operation panel 40 (S191). Thereafter, the printer 100 abnormally terminates the double-side printing feed process.

After determining that the double-side printing sheet has completely been ejected (S108: Yes), or after execution of S124, the printer 100 determines whether there is an unprinted page still remaining (S109). When determining that an unprinted page still remains (S109: Yes), the printer 100 goes back to S101, where the printer 100 starts feeding another double-side printing sheet. Meanwhile, when determining that an unprinted page still remains (S109: No), the printer 100 normally terminates the double-side printing feed process.

Figure 6:
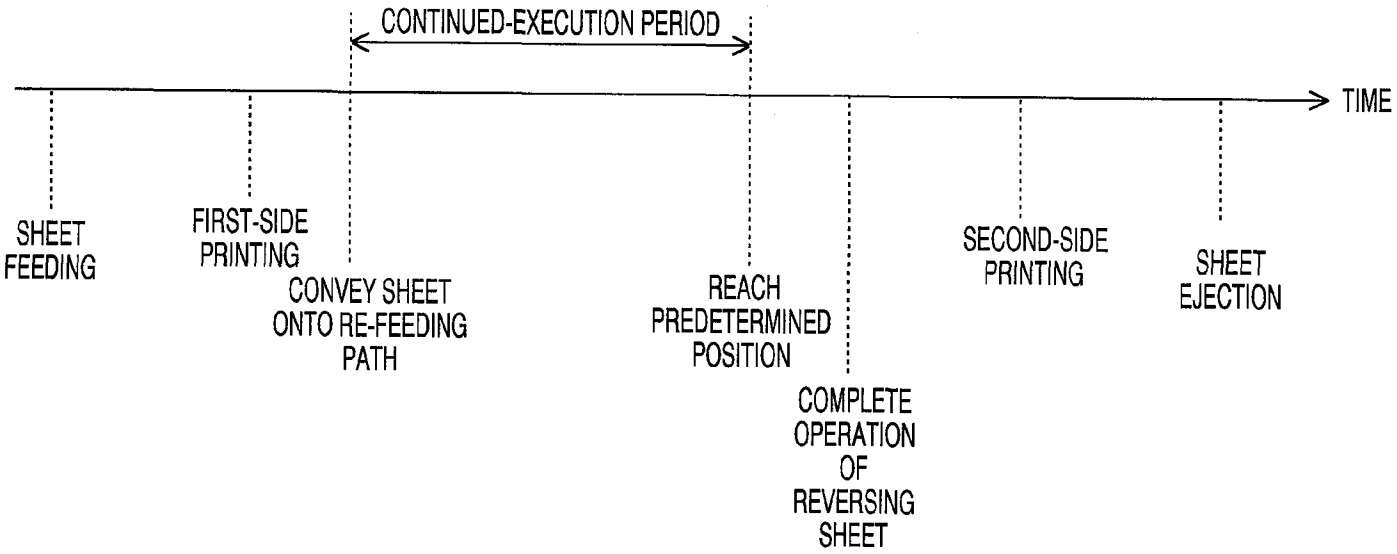
FIG. 6 is a time chart showing a continued-execution period defined in a double-side printing operation in the first embodiment according to one or more aspects of the present invention.

FIG. 6 is a time chart showing an operational procedure of the printer 100 during a time period between an earlier time when a double-side printing sheet is fed and a later time when the double-side printing sheet is ejected. In the double-side printing feed process of the first embodiment, a manually-fed sheet is accepted during a time period between an earlier time when the double-side printing sheet is conveyed onto the re-feeding path 12 and a later time when the double-side printing sheet reaches the predetermined position (i.e., a "continued-execution period" shown in FIG. 6). Therefore, a manually-fed sheet inserted during the continued-execution period is conveyed into the printer 100 and ejected via the process portion 50. Namely, in the double-side printing feed process of the first embodiment, when a manually-fed sheet is inserted during the continued-execution period, the double-side printing feed process is continuously executed. In this case, it is possible to retain continuity in a double-side printing operation.

Second Embodiment

Figure 7:
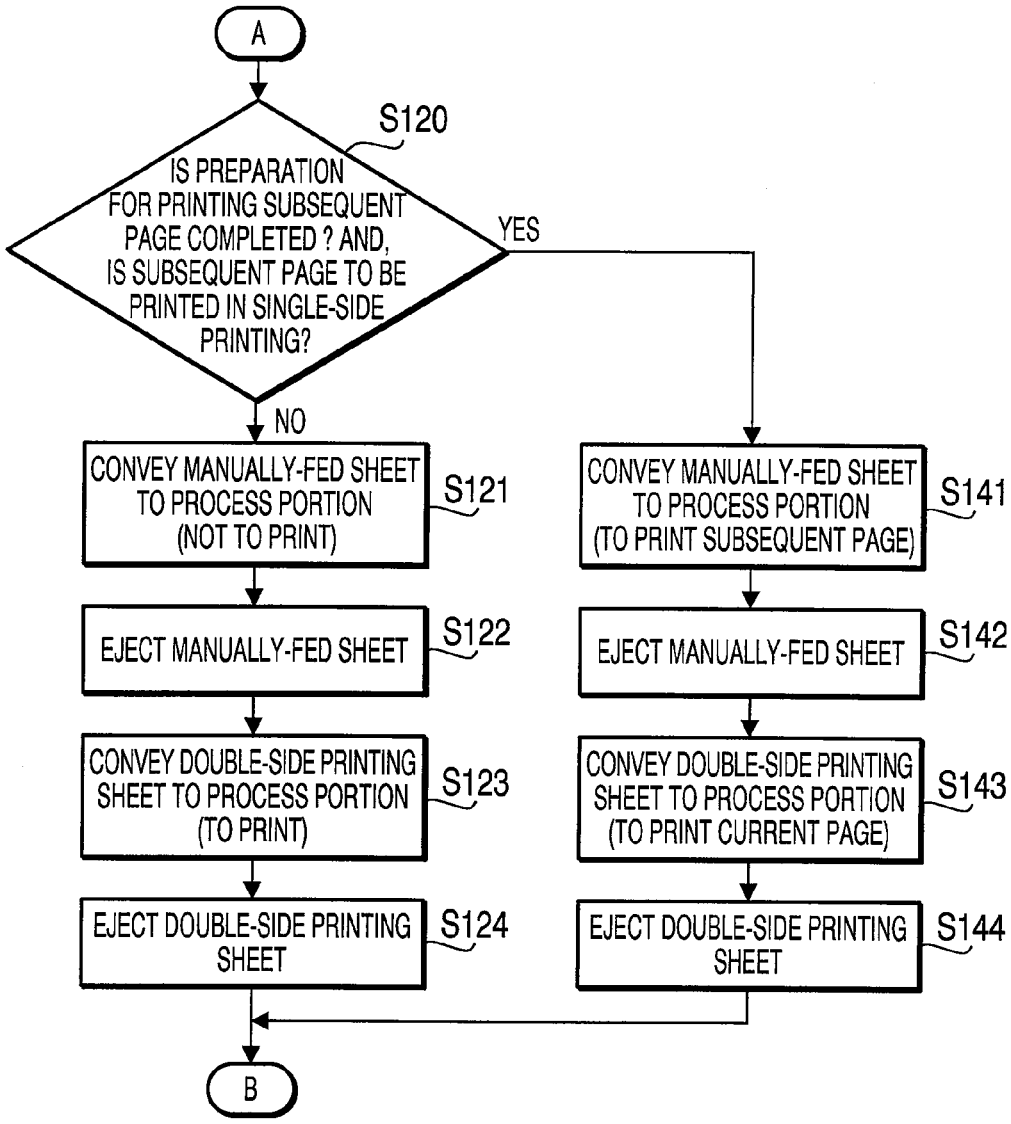
FIG. 7 is a flowchart showing a partial procedure of a double-side printing feed process in a second embodiment according to one or more aspects of the present invention.

Subsequently, an explanation will be provided about a double-side printing feed process to be executed by the printer 100 (the CPU 31) in a second embodiment, with reference to FIG. 7. In the second embodiment, even though a manually-fed sheet is inserted during a double-side printing operation, the printer 100 performs printing on the manually-fed sheet under a predetermined condition. In this respect, the second embodiment is different from the first embodiment where a manually-fed sheet inserted during a double-side printing operation is always ejected with no image printed thereon.

The second embodiment represents an application example in the case where a manually-fed sheet is inserted during the continued-execution period between the time when the operation of reversing the double-side printing sheet is begun and the time when the double-side printing sheet reaches the predetermined position on the re-feeding path 12 (S105: Yes). Namely, FIG. 7 shows a modification of the operations executed between "A" and "B" shown in FIG. 5. It is noted that with respect to the same operations as those in the first embodiment, the same step numbers as the first embodiment will be attached thereto, and explanations about them will be omitted.

First, the printer 100 determines whether preparation is completed for printing a page (hereinafter referred to as a "subsequent page") following a page (hereinafter referred to as a "current page") to be printed on the second side of the double-side printing sheet which is currently being conveyed on the re-feeding path 12, and whether the subsequent page is to be printed in single-side printing (S120). It is noted that the "subsequent page" has only to be a page that is to be printed on a sheet to be fed after double-side printing is completely performed for the double-side printing sheet which is currently being conveyed. The "subsequent page" is not limited to a page next to a page to be printed on the double-side printing sheet which is currently being conveyed, but, for instance, may be a final page. Further, completed preparation for printing the subsequent page is determined, e.g., based on whether print data of the subsequent page is completely extracted.

Namely, in S120, the printer 100 determines whether the printer 100 is in a state to be able to start printing the subsequent page at the time to detect a manually-fed sheet (S105:

Yes). Moreover, the printer 100 determines whether the subsequent page is to be printed in single-side printing to perform printing on only a single side of a sheet.

When preparation is completed for printing the subsequent page and the subsequent page is to be printed in single-side printing (S120: Yes), the printer 100 conveys the manually-fed sheet to the process portion 50 (S141). At this time, since it is possible to print the subsequent page, the printer 100 prints the subsequent page on the manually-fed sheet. Thereafter, the printer 100 ejects the manually-fed sheet with a single side thereof printed (S142).

After that, the printer 100 returns the double-side printing sheet onto the forward feeding path 11 and conveys the double-side printing sheet to the process portion 50 (S143). Then, the printer 100 prints the current page on the second side of the double-side sheet. Thereafter, the printer 100 ejects the double-side printing sheet with the first and second sides thereof printed (S144).

Meanwhile, when preparation is not completed for printing the subsequent page or the subsequent page is to be printed in double-side printing (S120: No), in the same manner as the first embodiment, the printer 100 ejects the manually-fed sheet with no image printed thereon (S121, and S122), and prints the current page on the second side of the double-side printing sheet and then ejects the double-side printing sheet (S123 and S124).

Namely, in the double-side printing feed process of the second embodiment, when preparation is completed for printing the subsequent page, and the subsequent page is not to be printed in double-side printing, the printer 100 determines to be able to print the subsequent page on the manually-fed sheet, and prints the subsequent page on the manually-fed sheet. Thereby, it is possible to render feeding of the manually-fed sheet not useless and acquire a sheet with the subsequent page printed thereon earlier. Thus, it is possible to shorten a time period taken for executing the print job as a whole.

As described above, according to the embodiments, the time period between the time when the operation of reversing the double-side printing sheet is begun and the time when the double-side printing sheet reaches the predetermined position on the re-feeding path 12 is defined as the continued-execution period. When a manually-fed sheet is inserted during the continued-execution period, even in execution of the double-side printing operation, the double-side printing operation is continued. Meanwhile, when a manually-fed sheet is inserted outside the continued-execution period, the double-side printing operation is stopped. Namely, when a manually-fed sheet is inserted outside the continued-execution period (S103: Yes, or S107: Yes), the printer 100 stops the double-side printing operation to avoid a feeding error, such as a sheet jam and overlap between sheets, which might be caused due to interference between the double-side printing sheet and the manually-fed sheet. Meanwhile, when a manually-fed sheet is inserted during the continued-execution period (S105: Yes), the printer 100 conveys the manually-fed sheet to the process portion 50 and ejects the manually-fed sheet, and completes the double-side printing operation for the double-side printing sheet. In other words, even though a manually-fed sheet is inserted via the manual feeding path 13, when the feeding of the manually-fed sheet is carried out during a predetermined period (the continued-execution period), a printing operation in execution can be continued and efficiently completed.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible.

For example, aspects of the present invention may be applied to devices having a double-side printing function such as a multi-function peripheral (MFP) and a facsimile machine, as well as a printer as exemplified in the aforementioned embodiments. Further, the image forming method of the image forming unit 10 is not limited to the electrophotographic method, but may be an inkjet method. Further, the image forming unit 10 may be configured to form a color image, or configured just for forming a monochrome image.

Further, in the aforementioned embodiments, there is no element disposed on the manual feeding path 13 to assist an operation of inserting a manually-fed sheet via the manual feeding path 13 (e.g., feed rollers). However, one or more elements may be disposed on the manual feeding path 13 to assist an operation of inserting a manually-fed sheet via the manual feeding path 13.

Further, in the aforementioned embodiments, the period between the time when the operation of reversing the double-side printing sheet is begun and the time when the double-side printing sheet reaches the predetermined position on the re-feeding path 12 is defined as the continued-execution period. However, any period during which the double-side printing operation is presumed to be able to be continued may be defined as the continued-execution period. In this case, the continued-execution period may appropriately be determined as needed based on an extent to which a risk of a feeding error is accepted or the location of the re-feeding path 12. For example, the predetermined position on the re-feeding path 12 may not vary depending on a sheet size, but may be fixed. Further, when the junction between the re-feeding path 12 and the forward feeding path 11 is located far from the junction 14 between the manual feeding path 13 and the forward feeding path 11, the predetermined position may be provided on the forward feeding path 11.

What is claimed is:

1. A printer comprising:

a double-side feeding path configured such that a first sheet is conveyed thereon in a double-side printing operation;

a manual feeding path configured such that a manually-fed second sheet is conveyed therethrough to a junction where the manual feeding path joins the double-side feeding path;

a detector configured to detect the second sheet manually fed via the manual feeding path; and a controller configured to, when the detector detects the second sheet during a continued-execution period, continue the double-side printing operation for the first sheet being conveyed on the double-side feeding path, wherein the controller is further configured to, when the detector detects the second sheet outside of the continued-execution period, stop the double-side printing operation, and wherein the continued-execution period is a time period during which a trailing end of the second sheet passes through the junction where the manual feeding path joins the double-side feeding path before a leading end of the first sheet reaches the junction so as to prevent the feeding of the second sheet from disturbing the feeding of the first sheet.

2. The printer according to claim 1, wherein when the detector detects the second sheet during the continued-execution period, the controller performs a printing operation to print, on the second sheet, an image to be printed on a sheet following the first sheet which is being conveyed on the double-side feeding path.

3. The printer according to claim 2, wherein in a case where the controller determines that it is possible to completely perform the printing operation on the second sheet, the controller performs the printing operation, and wherein in a case where the controller determines that it is impossible to completely perform the printing operation on the second sheet, the controller ejects the second sheet without performing the printing operation or reversing the second sheet.

4. The printer according to claim 3, wherein the case where the controller determines that it is possible to completely perform the printing operation on the second sheet comprises a case where the image, which is to be printed on a sheet following the first sheet which is being conveyed on the double-side feeding path, is an image to be printed in single-side printing.

5. The printer according to claim 1, wherein when the detector detects the second sheet during the continued-execution period, the controller ejects the second sheet without performing the double-side printing operation or reversing the second sheet.

6. The printer according to claim 1, wherein the double-side feeding path comprises a re-feeding path configured such that the first sheet is reversed therethrough, and wherein the continued-execution period is further defined by a time period between an earlier time when the first sheet is conveyed into the re-feeding path and a later time when the first sheet reaches a predetermined position located, along the re-feeding path, upstream of the junction in a sheet feeding direction in which the first sheet is conveyed on the double-side feeding path.

7. The printer according to claim 6, wherein the predetermined position is determined depending on a sheet size of the first sheet.

8. A method, configured to be implemented on a processor, for controlling a printer that comprises:

a double-side feeding path configured such that a first sheet is conveyed thereon in a double-side printing operation;

a manual feeding path configured such that a manually-fed second sheet is conveyed thereon to a junction where the manual feeding path joins the double-side feeding path; and a detector configured to detect the second sheet manually fed via the manual feeding path, wherein the method comprises the steps of:

determining whether the detector detects the second sheet during a continued-execution period, wherein the continued-execution period is a time period during which a trailing end of the second sheet passes through the junction where the manual feeding path joins the double-side feeding path before a leading end of the first sheet reaches the junction so as to prevent the feeding of the second sheet from disturbing the feeding of the first sheet;

when it is determined that the detector detects the second sheet during the continued-execution period, continuing the double-side printing operation for the first sheet which is being conveyed on the double-side feeding path; and when it is determined that the detector detects the second sheet outside the continued-execution period, stopping the double-side printing operation.

9. The method according to claim 8, further comprising a step of, when it is determined that the detector detects the second sheet during the continued-execution period, performing a printing operation to print, on the second sheet, an image to be printed on a sheet following the first sheet which is being conveyed on the double-side feeding path.

10. The method according to claim 9, further comprising the steps of:

determining that it is possible to completely perform the printing operation on the second sheet;

in a case where it is determined that it is possible to completely perform the printing operation on the second sheet, performing the printing operation; and in a case where it is determined that it is impossible to completely perform the printing operation on the second sheet, ejecting the second sheet without performing the printing operation or reversing the second sheet.

11. The method according to claim 10, wherein the case where it is determined that it is possible to completely perform the printing operation on the second sheet comprises a case where the image, which is to be printed on a sheet following the first sheet which is being conveyed on the double-side feeding path, is an image to be printed in single-side printing.

12. The method according to claim 8, further comprising a step of, when it is determined that the detector detects the second sheet during the continued-execution period, ejecting the second sheet without performing the printing operation or reversing the second sheet.

13. The method according to claim 8, wherein the double-side feeding path comprises a re-feeding path configured such that the first sheet is reversed therethrough, and wherein the continued-execution period is further defined by a time period between an earlier time when the first sheet is conveyed into the re-feeding path and a later time when the first sheet reaches a predetermined position that is located, along the re-feeding path, upstream of the junction in a sheet feeding direction in which the first sheet is conveyed on the double-side feeding path.

14. The method according to claim 13, wherein the predetermined position is determined depending on a sheet size of the first sheet.

* * * * *